United States Patent [19]

Kongoh et al.

[11] Patent Number: 4,532,876

[45] Date of Patent: Aug. 6, 1985

[54] ELECTRONIC SEWING MACHINE

[75] Inventors: Takeshi Kongoh; Haruhiko Tanaka, both of Tokyo, Japan

[73] Assignee: Janome Sewing Machine Industry Co., Ltd., Tokyo, Japan

[21] Appl. No.: 611,680

[22] Filed: May 18, 1984

[30] Foreign Application Priority Data

May 18, 1983 [JP] Japan ..... 58-85796

[51] Int. Cl.[3] ..... D05B 3/02

[52] U.S. Cl. ..... 112/454; 112/266.1; 112/317; 112/451

[58] Field of Search ..... 112/158 E, 317, 316, 112/121.11, 121.12, 262.1, 266.1

[56] References Cited

U.S. PATENT DOCUMENTS 4,266,493 5/1981 Hanyu et al. ..... 112/158 E 4,393,795 7/1983 Makabe et al. ..... 112/158 E

*Primary Examiner*—Peter Nerbun

*Attorney, Agent, or Firm*—Frishauf, Holtz, Goodman & Woodward

[57] ABSTRACT

In an electronically controlled sewing machine having a memory storing a plurality of stitch patterns among which a desired one or combination may be selectively read out therefrom to produce the same, it is detected if a pattern designated to be followed by a lock stitch pattern and memorized accordingly in the memory is of a first type which includes the last stitch to be produced by initial data stored in the memory for producing the initial stitch of the pattern, or of a second type which includes the last stitch to be produced by the last data stored in the memory for producing the last stitch of the pattern, and according to the result of the detection, the sewing machine is operated to continuously produce the lock stitch pattern after the initial data has been issued from the memory for producing the pattern of the first type or after the last data has been issued from the memory for producing the pattern of the second type. The sewing machine is automatically stopped from further operation after the lock stitch pattern has been finished.

2 Claims, 8 Drawing Figures

ELECTRONIC SEWING MACHINE

BACKGROUND OF THE INVENTION

This invention relates to an electronic sewing machine capable of producing a desired one or combination of stitch patterns with predetermined stitch control data thereof which may be selectively read out by the machine operator.

In an electronic sewing machine, a selected one or combination of stitch patterns can be produced with a predetermined stitch control data for determining the needle penetrating positions in series. For example, a triangular shaped pattern as shown in FIG. 1 has its own data comprising a set of coordinates $A_1$ to $A_{10}$, and a parallelogram shaped pattern as shown in FIG. 2 is produced with a set of coordinate determining data for the stitches $B_1$ to $B_{12}$. In this connection it is to be noted that for the purpose of sequentially producing the same pattern in series, the stitch control data for the last stitch ($A_{10}$, $B_{12}$) of each pattern will generally be coupled with the initial data for the first stitch ($A_1$, $B_1$). Thus, when the machine operator so desires, a plurality of the same pattern can be continuously produced as shown in FIG. 1 or 2.

Meanwhile, it may be often required to produce the lock stitches at the last stage of any pattern for the purpose of preventing the thread from being frayed or loosened. When the pattern of FIG. 1 is followed by the lock stitches, the lock stitches are started from the last point $A_1$ which is stitched due to the initial address data for the first stitch $A_1$ stored in the memory in combination with the stitch control data for the last stitch $A_{10}$, thereby making it possible to produce the stitch pattern as desired, as shown in FIG. 3. However, in the last case of the pattern of FIG. 2 being followed by the lock stitches, the lock stitch has been undesirably produced from the stitching point $B_1$ as shown in FIG. 5. In this case the lock stitch forming operation should preferably be commenced from the last stitching point $B_{12}$ of the preceding pattern as shown in FIG. 4, which has, nevertheless, not been performed in the prior art.

SUMMARY OF THE INVENTION

Accordingly, it is an object of the invention to eliminate the defects and disadvantages of the prior art which have been encountered in the formation of the lock stitches accompanying the last stitch of one or a series of patterns.

It is another object of the invention to provide an electronic sewing machine capable of producing a desired one or combination of stitch patterns with the accompanying lock stitches with a beautiful appearance, independently of the types of the stitch pattern to be accompanied by the lock stitches.

A plurality of stitch patterns stored in an electronic memory in a sewing machine can be classified into two groups, in accordance with a type of their own stitch control data. More particularly, a pattern such as shown in FIG. 1, for example, is produced with a set of predetermined stitch control data for sequentially determining needle coordinates from $A_1$ to $A_{10}$, of which the last stitch $A_1$ is also the first stitch of the next pattern. Such a kind of stitch pattern is hereby defined to belong to a first group. The other group of stitch pattern will be a pattern as shown in FIG. 2, for example, which is formed with the stitch control data providing a set of predetermined coordinates from $B_1$ to $B_{12}$, of which the last stitch $B_{12}$ is not common to the first stitch of the next pattern. This kind of pattern is classified into a second group. This invention aims to produce the lock stitches immediately after the properly defined last stitch of one or a series of such patterns has been stitched.

BRIEF DESCRIPTION OF THE DRAWINGS

The foregoing and further objects and advantages of the invention can be fully understood from the following detailed description when read in conjunction with the accompanying drawings in which:

FIGS. 1 and 3 diagrammatically show one type of stitch pattern which may be classified into a first group, in which FIG. 1 shows a number of patterns stitched in series and FIG. 3 shows a single of the pattern followed by the lock stitches;

FIGS. 2, 4 and 5 diagrammatically show another type of stitch pattern which may be classified into a second group, in which FIG. 2 shows a number of the patterns in series, FIG. 4 shows a single pattern followed by the lock stitches in accordance with the invention and FIG. 5 shows a single pattern followed by the lock stitches produced according to the prior art;

PREFERRED EMBODIMENT OF THE INVENTION

Figure 6:
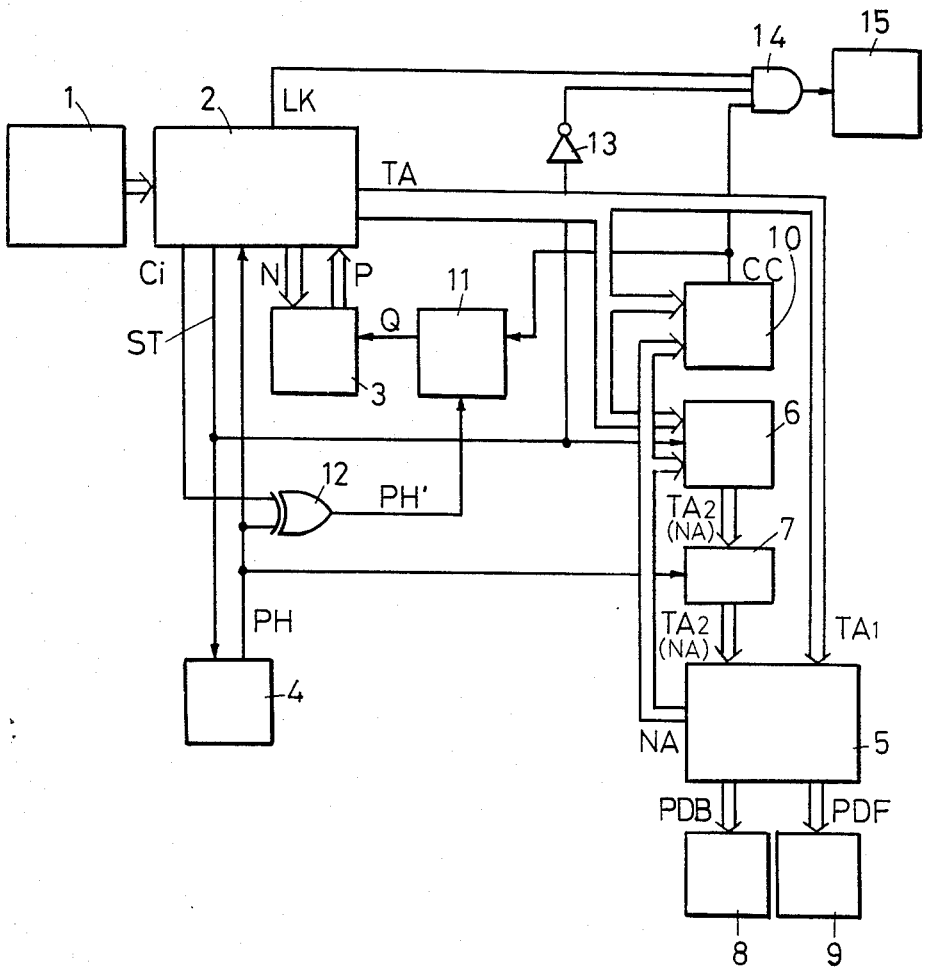
FIG. 6 is a diagram of a control circuit of the invention.

A preferred embodiment of the invention will now be described in detail in reference to the accompanying drawings. More particularly, specifically referring to FIG. 6 illustrating a block diagram of a control circuit according to the invention, an information input unit 1 generally comprises a pattern selecting switch for selecting a desired one or combination of stitch patterns including a lock stitch pattern, and a memory switch to be operated each time after the pattern selecting switches has been operated for memorizing a group of patterns to be sequentially produced. The selective operation of the unit 1 will give a corresponding pattern number signal to a pattern number control unit 2, which receives and memorizes the selected pattern number in a predetermined storing position. Counting operation is performed by a stack counter 3 each time a stitch pattern number is stored in the control unit 2 and the total number (N) of stitch patterns to be sequentially produced as designated by operation of the unit 1 is preset by the counter 3. During the stitching operation, the counter 3 will at first make a count signal (P) as -1- in response to a stitch start signal which is made effective generally by operation of a controller (not shown), and the count signal (P) is advanced one by one in response to a signal (Q) which is described later.

The signal (P) is given back to the control unit 2 for designating a corresponding one of the stitch patterns stored therein. More particularly, in response to the count value -1- of the signal (P) supplied from the stack counter 3, the control unit 2 is operated to produce a "H" level start signal (ST) and at the same time an address signal (TA) for the first pattern which has been just designated by the signal (P) from the counter 3.

The address signal (TA) has the first part ($TA_1$) applied to a memory 5 storing stitch control data and the second part ($TA_2$) transmitted to a multiplexer 6. The address signal ($TA_2$) is then issued from the multiplexer 6 while the latter receives the "H" level start signal (ST) from the control unit 2. When the start signal (ST) is, in turn, at the "L" level, the multiplexer 6 is adapted to produce a next address signal (NA) in place of the second address signal ($TA_2$). An address latch circuit 7 latches the address signal ($TA_2$) or (NA) each rising point of a phase signal (PH) from a drive shaft phase signal generator 4. The signal generator 4 produces the "H" level phase signal (PH) each time the start signal (ST) from the control unit 2 is made "H" level. On the contrary, during the stitching operation, the drive shaft phase signal generator 4 produces the "H" level phase signal (PH) each time a laterally swingable needle (not shown) ascends to reach above the fabric and, in turn, produces the "L" level phase signal (PH) while the needle is positioned under the fabric.

With the address signals ($TA_1$) and ($TA_2$) being applied, the memory 5 produces the needle position control data PDB and the fabric feed amount control data PDF both for the first stitch of the selected pattern, and the next address signal (NA) for reading out the next stitch control data.

When the needle descends to penetrate the fabric and then the phase signal (PH) is changed to the "L" level, the start signal (ST) simultaneously becomes to the "L" level. Then, the multiplexer 6 generates another next address signal (NA). When the phase signal (PH) is turned again to the "H" level, the next address signal (NA) supplied from the multiplexer 6 is latched in the latch circuit 7 whereby the address signal ($TA_2$) will read out the next needle position control data PDB and the fabric feed amount control data PDF for the next stitch of the selected pattern.

Where the selected combination of stitch patterns includes a lock stitch pattern as the last designated pattern, the control unit 2 will produce a pulse signal (Ci) while the preceeding pattern (that is, the last but one pattern) and the last lock stitch pattern are being produced. More particularly, the control unit 2 will detect whether the last but one stitch pattern to be followed by the lock stitch pattern is classified into the first or second group, and produce the "L" level cycle control signal (Ci) for the first group stitch pattern or alternatively the "H" level cycle control signal (Ci) for the second group. While the stitch pattern not to be followed by the lock stitch is being produced or when the memory switch has not been operated to intend formation of only one stitch pattern, the cycle control signal (Ci) will remain "L" level.

Figure 7:
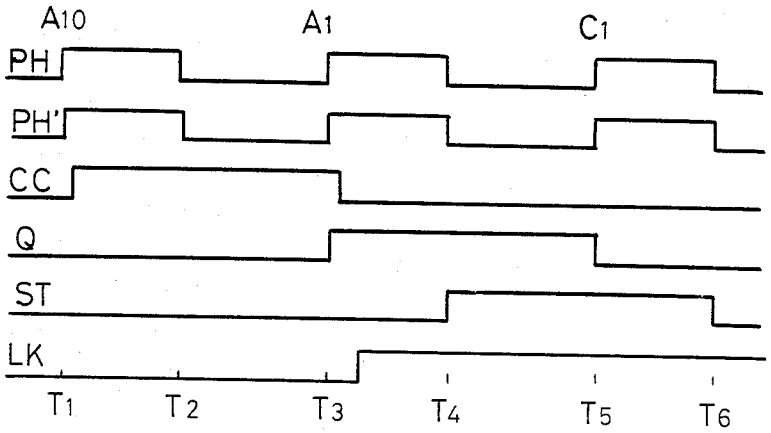
FIG. 7 is a pulse form diagram showing the operation of the principal elements of the control circuit of the invention, when the lock stitches have been designated to accompany the pattern of the first group.

The stitch control data PDB and PDF per stitch of the selected pattern are supplied from the memory 5 to a needle position control unit 8 and a fabric feed control unit 9 respectively, thereby performing the stitching operation of the said stitch. In the memory 5, the stitch control data PDB and PDF for the last stitch of each pattern are coupled with the address data (TA) of the first stitch of the pattern which is given, as the next address (NA), to a comparator circuit 10. The comparator circuit 10 compares the next address (NA) from the memory 5 with the address signal (TA) from the control unit 2, and when these two signals coincide with each other produces the "H" level coincidence signal (CC) at a little delayed timing of a rising point of the phase signal (PH), as shown in FIG. 7. A second latch circuit 11 will latch the coincidence signal (CC) at a rising time of a signal (PH') from an exclusive OR circuit 12, thereby producing a pattern renewal signal (Q). The exclusive OR circuit 12 has inputs connected to the cycle control signal (Ci) and the phase signal (PH) so that the signal (PH') produced therefrom has the same pulse form as that of the phase signal (PH) being "L" level or the reversed pulse form when the phase signal (PH) is "H" level. The counter 3 counts up the value (P) one by one at each rising time of the signal (Q), but when the value has reached the total number (N) of the patterns which has been already stored in the counter 3 the value (P) is returned to -1- due to the next rising time of the signal (Q).

When the signal (P) from the counter 3 designates the lock stitch pattern whose pattern number has been memorized in the control unit 2, a lock stitch designating signal (LK) of "H" level is produced from the control unit 2 due to a rising point of the signal (Q) with a little more delayed timing than in the case of the coincidence signal (CC). The lock stitch designating signal (LK) remains "H" level during the entire period of formation of the lock stitch pattern, and when the lock stitch has been finished to complete formation of the selected stitch patterns in series an AND circuit 14 having inputs connected to the "H" level lock stitch designating signal (LK), the "H" level coincidence signal (CC) and the "H" level signal inverted from the "L" level start signal (ST) via an inverter 13, will produce the "H" level signal to a brake mechanism 15 which is thereby actuated to stop the sewing machine from operation.

Figure 3:
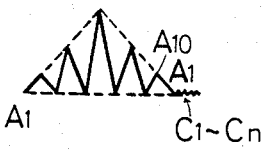

The operation of the above-identified control circuit of the invention is as follows: It is now assumed that the selective operation of the information input unit 1 will select and memory a triangular shaped pattern to be followed by the lock stitch pattern for the purpose of producing the pattern as shown in FIG. 3. In this case, the total number (N) of -2- is set by the counter 3. At the first stage of the stitching operation, the control unit 2 is operative in response to the first one of the count signal (P) to produce the address signal (TA) for reading out the stitch control data stored in the memory 5 for the first stitch of the triangular shaped pattern. At the same time, the control unit 2 produces the "H" level start signal (ST) and the "L" level cycle control signal (Ci). The phase signal (PH) supplied from the signal generator 4 is at this time, at the "H" level. Responsive to the first address signal ($TA_1$) and the second address signal ($TA_2$) via the multiplexer 6 and the latch circuit 7, the memory 5 will read out the stitch control data PDB and PDF and the next address signal (NA) whereby the sewing machine is operated by means of the needle position control unit 8 and the fabric feed control unit 9 so as to form the first stitch ($A_1$). Then, the needle penetrates the fabric, resulting in that the phase signal (PH) from the drive shaft phase signal generator 4 is turned to the "L" level, and the start signal (ST) is turned to the "L" level which remains during the succeeding operation. After that, when the phase signal (PH) again becomes to the "H" level, the next address signal (NA) supplied from the multiplexer 6 is latched in the latch circuit 7 so that the stitch control data PDB and PDF for the next second stitch of the triangular shaped pattern are read out from the memory 5 to thereby produce the second stitch ($A_2$). The stitches ($A_3$) to ($A_9$) are formed in the same manner as above described.

Figure 1:
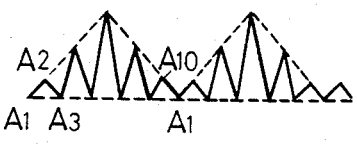
Figure 2:
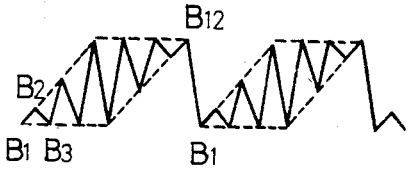

Referring additionally to FIG. 7, when the phase signal (PH) is then turned to the "H" level at the time ($T_1$), the stitch control data PDB and PDF for the last stitch ($A_{10}$) are read out from the memory 5 to form the same. The next address (NA) read out from the memory 5 together with the stitch control data PDB and PDF for the last stitch ($A_{10}$) at the time ($T_1$) comprises the address signal (TA) for the first stitch of the same pattern. The comparator circuit 10 then produces the "H" level coincidence signal (CC) at a time a little delayed than the time ($T_1$) as shown in FIG. 7. Since the cycle control signal (Ci) from the control unit 2 is at the "L" level for the pattern classified into the first group, the signal (PH') from the exclusive OR circuit 12 has the same pulse form as that of the phase signal (PH) from the signal generator 4. The signals (PH) and (PH') are then changed to the "H" level at the same time, that is at the time ($T_3$), which results in that the memory 5 reads out the stitch control data for the first stitch of the same pattern as shown in FIG. 1, to thereby form the first stitch ($A_1$), and that the signal (Q) from the latch circuit 11 becomes to the "H" level to thereby advance the value (P) of the counter 3 to -2-. The coincidence signal (CC) is turned to the "L" level at a time a little delayed than the time ($T_3$) and the lock stitch control signal (LK) is turned to the "H" level at a little more delayed timing, as specifically shown in FIG. 7. When the time ($T_4$) comes, that is the falling time of the phase signal (PH), the start signal (ST) for the lock stitch pattern becomes to the "H" level, and then the stitch control data are read out to thereby produce the first stitch ($C_1$) of the lock stitch pattern at the time ($T_5$), that is the rising time of the phase signal (PH). At the same time, the signal (Q) is changed to the "L" level at the rising point of the signal (PH'). The start signal (ST) is then turned to the "L" level at the time ($T_6$). The stitching operation of the lock stitch pattern is continuously performed in the same manner until a predetermined number of lock stitches ($C_1$) to ($C_n$) are completed, which makes the coincidence signal (CC) to the "H" level to actuate the brake mechanism 15. Thus, the sewing machine is automatically stopped from operation.

Figure 4:
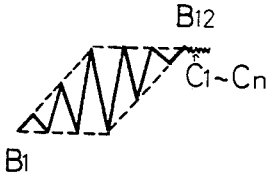
Figure 5:
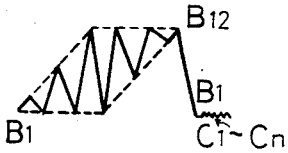
PRIOR ART FIG. 5
Figure 8:
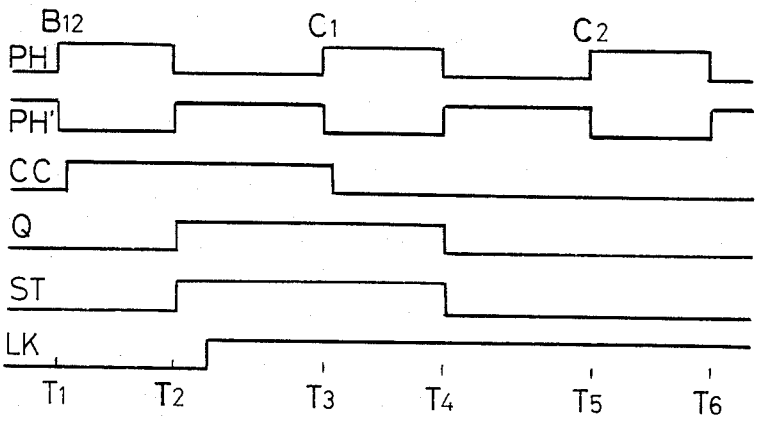
FIG. 8 is a pulse form diagram showing the operation of the principal elements of the control circuit of the invention, when the lock stitches have been designated to accompany the pattern of the second group.

Another combination of stitch patterns comprising one or more of a selected pattern of the second group and a lock stitch pattern, for example, a parallelogram pattern followed by the lock stitch pattern as shown in FIG. 4, can be produced with the electronic sewing machine of the invention in substantially the same manner as in the case of formation of the pattern as shown in FIG. 3. However, there is a difference that the cycle signal (Ci) of "H" level is continuously produced from the control unit 2 in the course of formation of the pattern of FIG. 4. More particularly, the stitch control data for the last stitch ($B_{12}$) are read out at the time ($T_1$) to thereby form the last stitch ($B_{12}$), and the coincidence signal (CC) is turned to the :H: level at a little delayed timing. When the signal (PH') rises to the "H" level at the time ($T_2$), the signal (Q) becomes to the "H" level so as to advance the value (P) to -2-, which signal (P) is supplied from the counter 3 to the control unit 2 for designating the lock stitch pattern to be followed. At the same time, the start signal (ST) is changed to the "H" level. Meanwhile, the lock stitch designating signal (LK) is turned to the "H" level at a time a little delayed than the time ($T_2$). When the phase signal (PH) then rises to the "H" level at the time ($T_3$), the stitch control data for the first stitch of the lock stitch pattern are read out from the memory 5 to thereby produce the first stitch ($C_1$). The coincidence signal (CC) is turned again to the "L" level at a time a little delayed than the time ($T_3$) as shown in FIG. 8. At the time ($T_4$), the start signal (ST) is turned to the "L" level due to the falling point of the phase signal (PH), and the signal (Q) is changed back to the "L" level due to the rising point of the signal (PH'). Further stitching operation of the lock stitch pattern and the automatic stopping operation are made in the same manner described in conjunction with the pattern of FIG. 3.

While the invention has been described in conjunction with a specific embodiment thereof, it is to be noted that the invention is not limited to the specific embodiment and many modifications and variations may be made without departing from spirit and scope of the invention.

What is claimed is:

1. An electronic sewing machine having stitch forming instrumentalities including a needle laterally swingable and vertically reciprocated to penetrate a fabric to be sewn and a fabric feeding device operated in a timed relation with the needle to transport the fabric, said electronic sewing machine comprising, in combination, (a) an electronic memory storing stitch control data predetermined specific to respective stitch patterns which may be sequentially read out to control the stitch forming instrumentalities, said stitch control data being composed of a set of coordinate determining data of needle penetrating points which are sequentially connected to thereby form stitches of a selected pattern;

(b) switch means for selecting a desired one or combination of the stitch patterns to thereby give a corresponding pattern number for the selected pattern to address said electronic memory for sequentially reading out the stitch control data specific to the selected pattern;

(c) first detection means for detecting whether the selected combination of the patterns includes a lock stitch pattern at the last thereof, said means being adapted to produce a signal when the lock stitch pattern is included in the selected combination;

(d) stop means operated in response to said signal from said first detecting means for stopping the sewing machine operation after the lock stitch pattern is finished;

(e) second detection means for detecting whether the selected pattern designated to be followed by the lock stitch pattern belongs to a first or second group, said first group comprising stitch patterns whose stitch control data are preset in said memory such that the last one stitch line necessary for completing a configuration thereof does not extend to the first stitch of the next pattern, and said second group comprising stitch patterns whose stitch control data includes the coordinate determining data of the last needle penetrating point of a first pattern which is identical to the first needle penetrating point of a succeeding pattern, said second detection means being adapted to produce a selective one of a first group command signal and a second group command signal in accordance with the detection; and (f) control means operated in response to said first or second group command signal from said second detection means to control the operation of said memory for starting the lock stitch forming operation at a time differently determined in dependence upon the detection by said second detection means, whereby the lock stitch pattern is connected to the last point of the configuration of the pattern designated to be followed by the lock stitch, independently of whether the pattern belongs to said first or second group.

2. A method for controlling an electronic sewing machine having a memory storing therein stitch control data for producing a plurality of stitch patterns including a number of different ornament patterns and a lock stitch pattern which is produced to lock the end of one or combination of the ornament patterns produced in series, said method comprising the step of:

selecting from said memory one of the ornament patterns or a combination of a number of the ornament patterns and the lock stitch pattern in a predetermined sequence;

memorizing said selected one or said number of the ornament patterns;

causing the sewing machine to detect if said memorized one or the last one of said ornament patterns is of a first type which includes the last stitch to be produced by the initial data stored in said memory for producing the initial stitch of said one or said last ornament stitch pattern, or of a second type which includes the last stitch to be produced by the last data stored in the memory for producing the last stitch of said one or said last ornament pattern;

causing the sewing machine to continuously produce said lock stitch pattern after said initial data has been issued from said memory for producing said last stitch of said one or said last ornament pattern in case that said one or said last ornament pattern is of the first type;

causing the sewing machine to continuously produce said lock stitch pattern after said last data has been issued from said memory for producing said last stitch of said one or said last ornament pattern in case that said one or said last ornament pattern is of the second type; and causing the sewing machine to stop the stitching operation when the lock stitch pattern has been finished.

* * * * *